US007097129B2

(12) United States Patent
Matthies

(10) Patent No.: US 7,097,129 B2
(45) Date of Patent: Aug. 29, 2006

(54) YARN WINDING MACHINE

(75) Inventor: Claus Matthies, Wasbek (DE)

(73) Assignee: Saurer GmbH & Co. KG, Monchengladbach (DE)

( * ) Notice: Subject to any disclaimer, the term of this patent is extended or adjusted under 35 U.S.C. 154(b) by 0 days.

(21) Appl. No.: 10/899,290

(22) Filed: Jul. 26, 2004

(65) Prior Publication Data

US 2005/0023406 A1 Feb. 3, 2005

(30) Foreign Application Priority Data

Aug. 1, 2003 (DE) ..... 103 35 237

(51) Int. Cl.
*B65H 67/48* (2006.01)

(52) U.S. Cl. ..... 242/473.5; 242/129.1; 242/474.5; 242/474.9

(58) Field of Classification Search ..... 242/473.5, 242/473.6, 474.4, 474.5, 474.8, 474.9, 129.1, 242/473.9
See application file for complete search history.

(56) References Cited

U.S. PATENT DOCUMENTS 3,964,723 A * 6/1976 Schippers et al. ..... 242/473.5
5,350,128 A * 9/1994 Deters et al. ..... 242/473.6
5,779,170 A * 7/1998 Siepmann et al. ..... 242/127
5,941,474 A * 8/1999 Cushing ..... 242/533.1
6,047,915 A * 4/2000 Jaschke ..... 242/473.9
6,402,078 B1 * 6/2002 Brockmueller et al. .. 242/473.6

FOREIGN PATENT DOCUMENTS

| | | |
|---|---|---|
| DE | 24 27 016 | 12/1975 |
| DE | 197 01 315 A1 | 7/1997 |
| EP | 0 757 658 B1 | 2/1997 |
| EP | 0 919 505 A1 | 6/1999 |
| JP | 51 011938 A | 1/1976 |

* cited by examiner

*Primary Examiner*—Kathy Matecki
*Assistant Examiner*—William E. Dondero
(74) *Attorney, Agent, or Firm*—Alston & Bird LLP

(57) ABSTRACT

A yarn winding apparatus for continuously winding yarns to packages. The winding apparatus has a plurality of winding spindles, which are mounted in cantilever fashion for rotation on a movable turret, and which are alternately guided between a winding position for winding the yarns and a doffing position for removing the packages and assembling fresh tubes. To put on the tubes on the winding spindle, a tube slip-on device is provided, which comprises a movable means for guiding the tubes. To make it possible to put on tubes on the winding spindles held in the doffing position even during the progressive movement of the turret, the guide means for slipping on the tubes is movable for a short time or distance synchronously with the winding spindle that is moved by rotation of the turret.

19 Claims, 7 Drawing Sheets

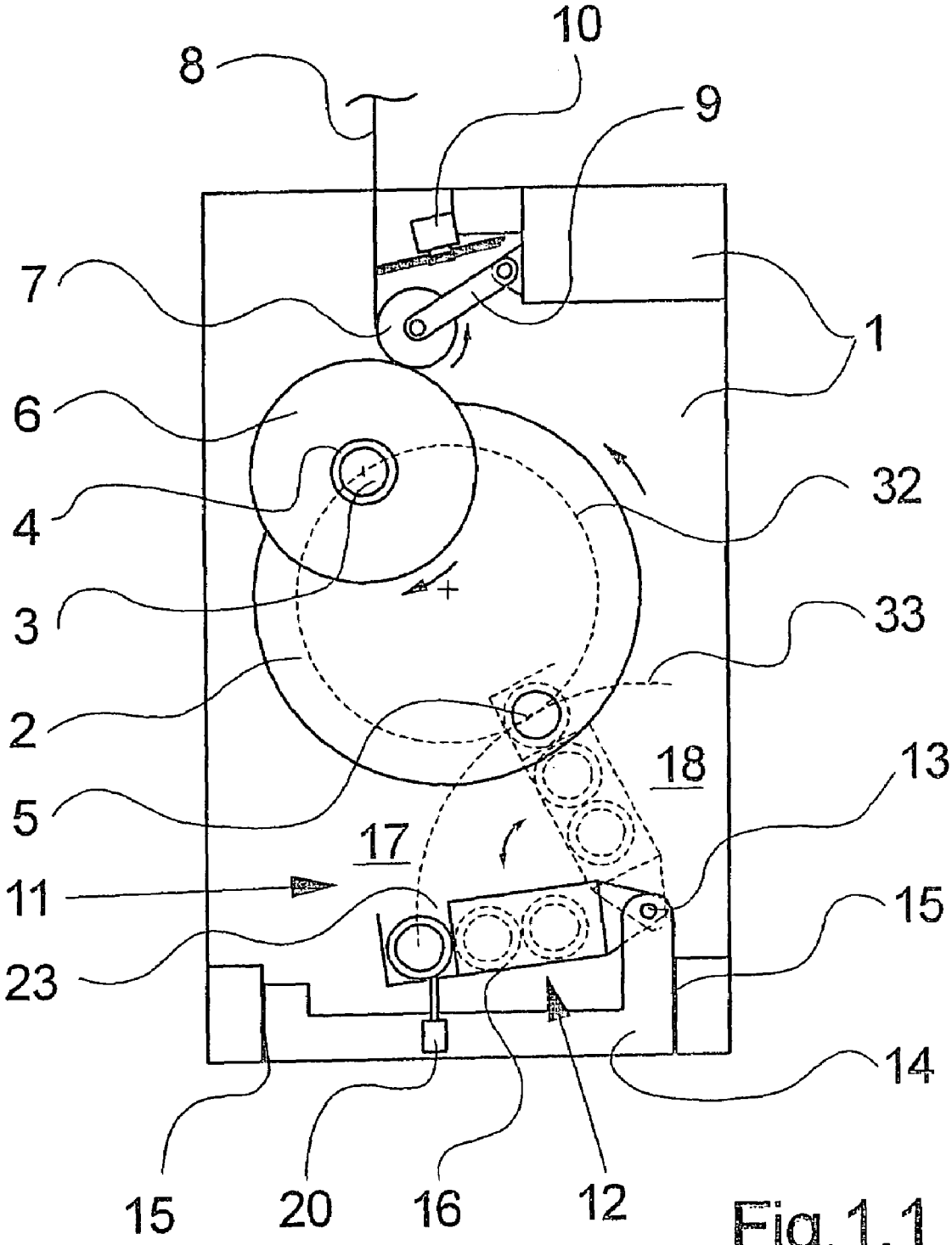
Fig.1.1

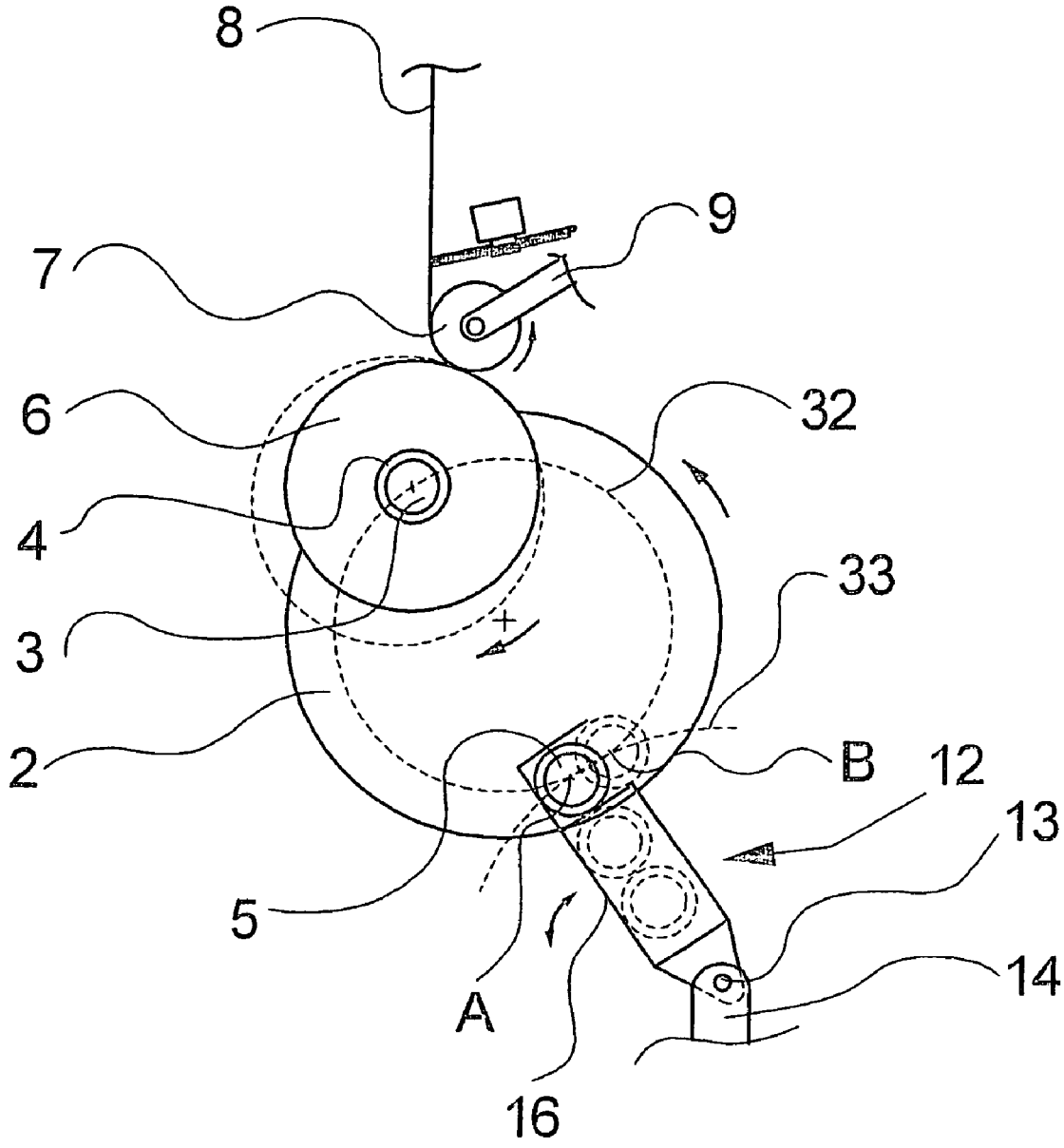
Fig.1.2

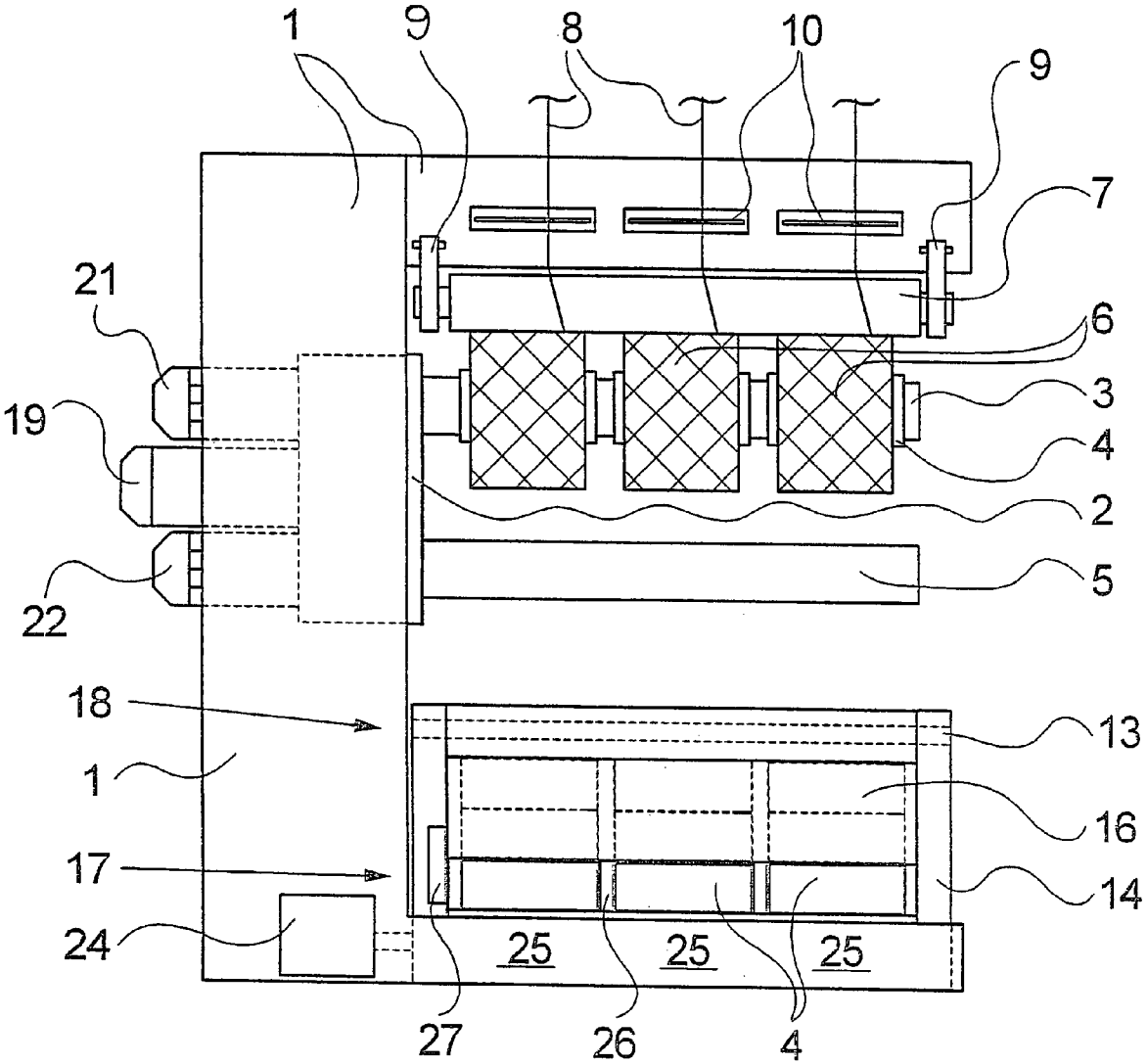
Fig.2.1

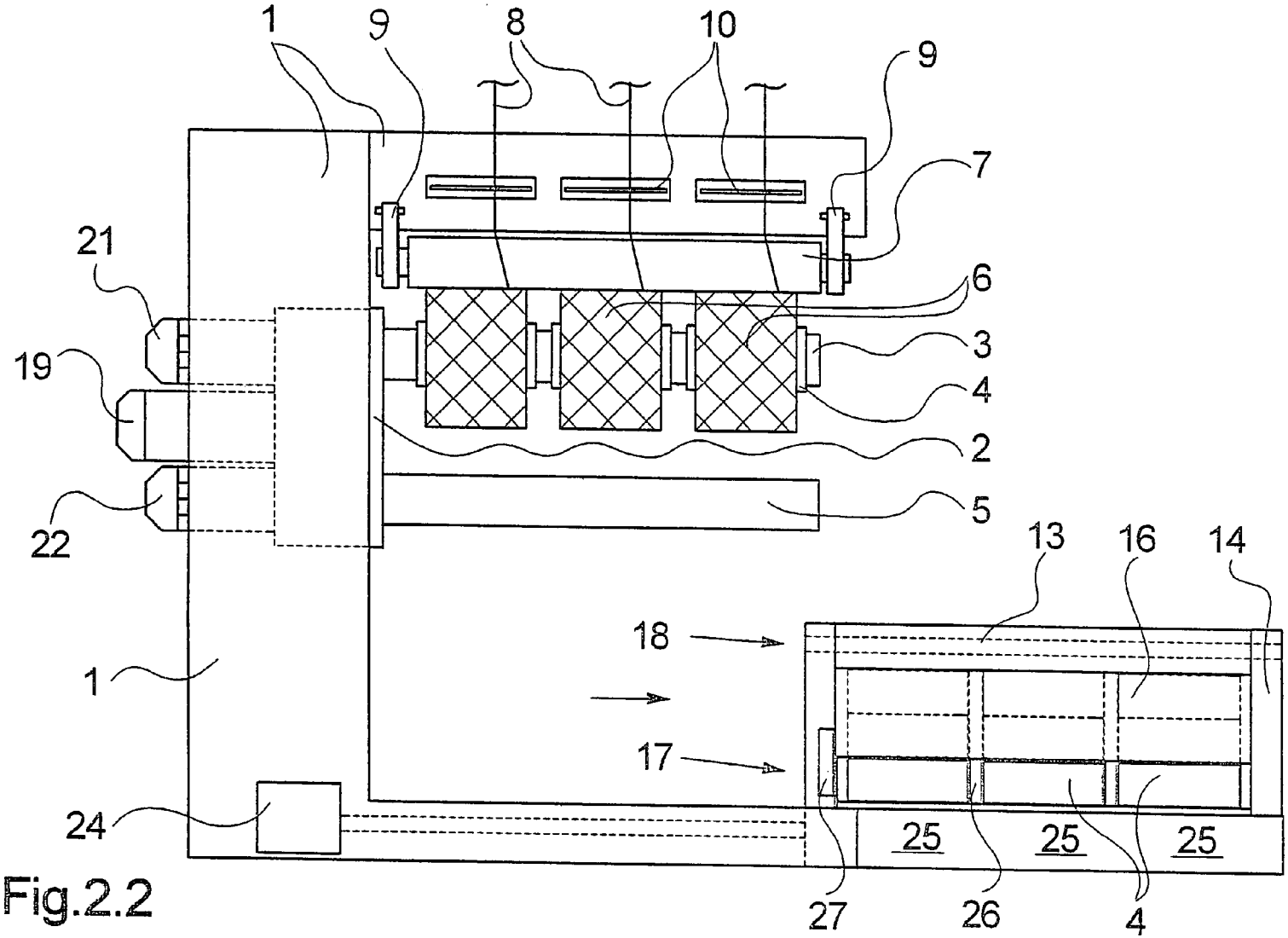
Fig.2.2

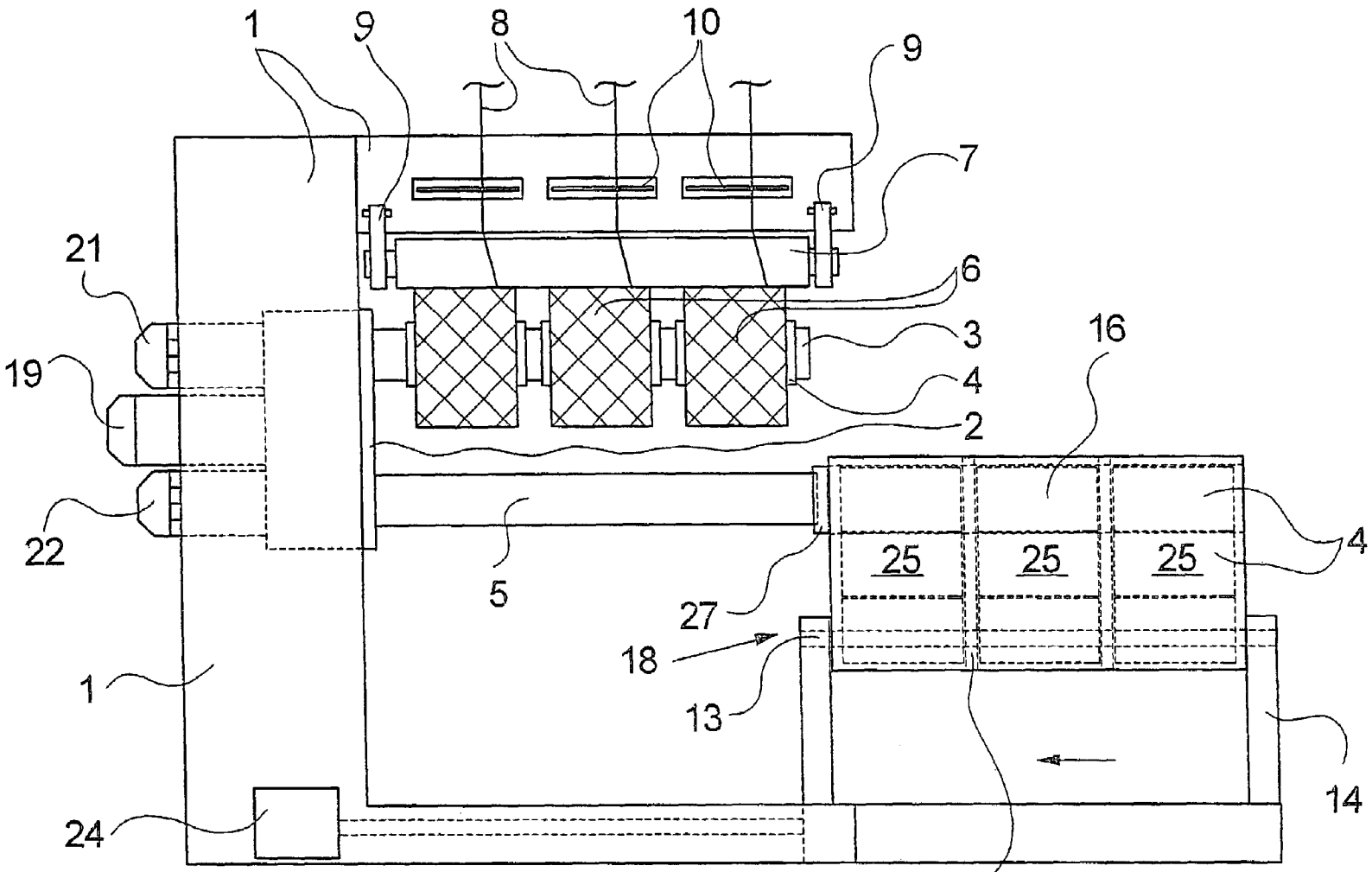
Fig.2.3

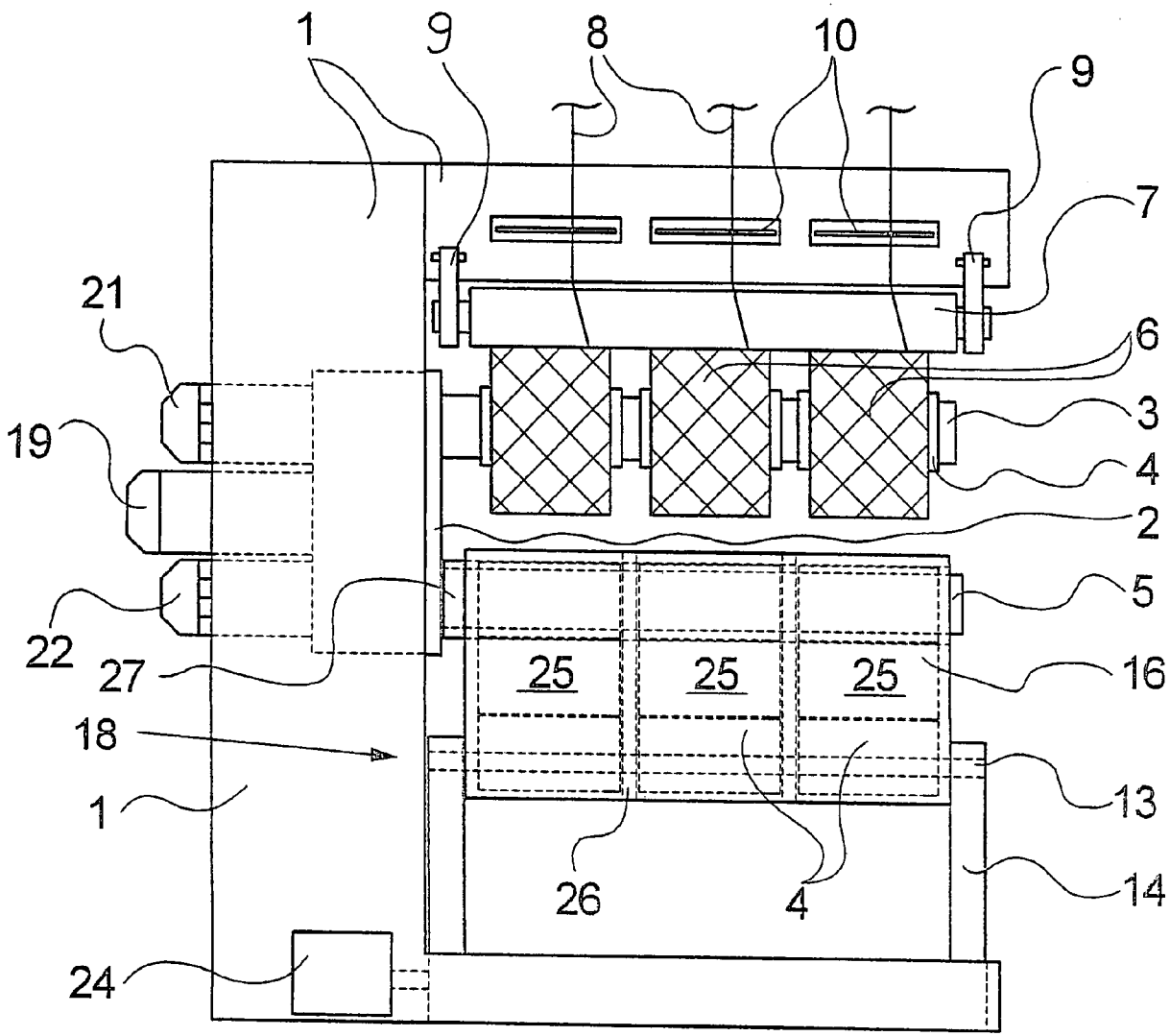
Fig.2.4

YARN WINDING MACHINE

BACKGROUND OF THE INVENTION

The present invention relates to a yarn winding machine for continuously winding advancing yarns into packages.

In the production of melt spun yarns in a spinning process, the yarns are wound to packages at the end of the production process. To this end, winding machines are used, which continuously wind a yarn to packages without interrupting the process. To this end, winding machines of this type comprise a plurality of winding spindles, which are mounted on a movable spindle support, also referred to as a turret herein, and alternately moved by means of the turret to a winding position for winding the yarns, and then to a doffing position for removing the fully wound packages and putting on new tubes. The yarn change from a first winding spindle to a second winding spindle occurs automatically, so that the spinning process need not be interrupted.

To slip one or more tubes over the winding spindle held in the doffing position after removing a fully wound package, various systems for such winding machines are known in the art.

DE 24 27 016 discloses a winding machine with a rotatable turret that mounts two winding spindles in cantilever fashion. To this end, the winding machine comprises a device for slipping the tubes on an empty winding spindle while it is in the doffing position. The tube slip-on device comprises a gripper arm, which is pivotally supported on an axle. The gripper arm is adapted for axial displacement along the axle. To slip a tube on the winding spindle held in the doffing position, the gripper arm removes a tube from a tube magazine, and puts it on the empty winding spindle by performing pivotal and axial sliding movements. In this process, the position of the winding spindle in the doffing position remains unchanged. However, such a tube slip-on device is not suitable for winding machines, in which the turret performs a bypassing movement for enabling in the winding position a package buildup on the winding spindle being in this position. In particular, in the winding process of so-called spin textured yarns, wherein yarns with coarser deniers are produced, and thus entail a rapid package buildup, it is not realistically possible to stop the turret for doffing the full packages or putting on the tubes.

In such winding machines, in which the turret performs a bypassing movement for winding the packages, the fully wound packages and the tubes are each removed and replaced automatically by means of so-called doffers. For example, EP 0 757 658 A1 discloses such a winding machine, in which a traveling doffer is equipped with a mandrel that holds the tubes. The doffer moves to a certain winding spindle position of the winding machine and slides the tubes onto the empty winding spindle. However, in this case it is necessary that the turret perform no movement at the moment when the winding spindle receives the tubes. Yet, in the winding of yarns with coarse deniers, only very short doffing times are available. Any disturbance in such a time-critical tube slip-on process would thus lead to a discontinuation of this process, and a new process would have to be started in a changed position of the winding spindle.

It is therefore an object of the invention to further develop a winding machine of the described type such that it permits putting on tubes in a simple manner also in the case of very short shutdown times of the winding spindle.

SUMMARY OF THE INVENTION

The above and other objects and advantages of the invention are achieved by the provision of a winding apparatus of the described type and wherein a movement of the winding spindle in the doffing position has no critical effect on supplying the winding spindle with new tubes. To this end, a guide means for slipping on the tubes is adapted for moving for a short time or distance synchronously with the winding spindle that is moved by the spindle support or turret. This enlarges the time window in which it is possible to slip the tubes on the winding spindle. The guide means follows the winding spindle for a short period, so that it is not necessary to interrupt the rotational movement of the spindle support or turret that is needed for winding the yarns on a second winding spindle located at the winding position.

A simple positioning occurs in that the guide means is arranged on the side next to the spindle support, that it can be moved between a standby position and an operating position laterally toward the winding spindle, and that in the operating position, the guide means can be mechanically linked with the winding spindle. This enables an easy alignment of the guide means with the winding spindle. Even during the rotational movement of the spindle support, no significant errors occur in the alignment between the free end of the winding spindle and the guide means.

To enable an axial relative movement between the guide means and the winding spindle also when the guide means and winding spindle are mechanically linked, it is advantageous to provide the guide means with a slide shoe, which lies in the operating position against the winding spindle, and sees to the mechanical linkup. To avoid differences in the sequences of movement, the movement of the winding spindle and the movement of the guide means are advantageously performed during the phase of the mechanical linkup by the drive of the spindle support.

However, it is also possible to adapt the drive of the spindle mount to a drive of the guide means, so that a synchronous movement exists for a short time. For example, it is thus possible to perform the connection also by electronic means.

For putting the tubes on the winding spindle, it is advantageous to mount the guide means for horizontal movement. This permits the guide means to position the tubes not only in facing relationship with the free end of the winding spindle, but also to slide the tubes onto the winding spindle.

In a particularly simple realization, the guide means is formed by a trough-like tube carrier, which is supported at its one end on a pivot pin, and which has at its opposite end an opening for releasing tubes that are successively stored in the tube carrier. With that, it is possible and advantageous to position and slide on a plurality of tubes at the same time. It is not necessary to handle the tubes each individually.

Preferably the pivot pin with the tube carrier is mounted on a carriage, which moves in the lower portion of the machine frame parallel to the winding spindles in the doffing range. With that, it is possible to slide the tubes in the positioned tube carrier onto the winding spindle in a simple manner.

Preferably, the tube carrier has a width that corresponds to the total length of the tubes placed on the winding spindle. With that, it is possible to slip on in one step all tubes that are arranged on a winding spindle. It is thus possible to put on the winding spindle as many as eight, ten, twelve, or even more tubes at the same time.

An additional, especially advantageous further development of the invention makes it possible to position the tubes on the winding spindle. In particular in the cases in which the tubes are supported on the winding spindle in spaced relationship with one another, it would be necessary to reposition on the winding spindle by separate means the tubes that are put on as a column. As a result of dividing the tube carrier over its width into a plurality of separate compartments, it is possible to associate to each winding position one compartment in the tube carrier, so that the tubes kept in the compartment are allocated to a certain winding position. The spacings between the compartments are made to correspond to the spacings for positioning the tubes on the winding spindle. When sliding the tubes onto the winding spindle, it is thus possible to associate the tubes with the positions of the winding positions.

To be able to perform in the case of manual interruptions because of process breakdowns, several tube feeds one after the other within a short time, the further development of the invention will be advantageous, in which the tube carrier has a depth for receiving a plurality of tubes per winding position.

In this connection, it is easy to cause the tubes to move up to a delivery position on the tube carrier in that in the standby position, the tube carrier is positioned higher at its support end than at its opposite end, so that the tube carrier has an inclined orientation.

When a plurality of tubes are used per winding position, it is possible to retain the tubes respectively held at the feed end in the case of a partial filling of the tube carrier, in that the tube carrier comprises in the region of the feed end a blocking device, which permits securing the tubes at the feed end of the tube carrier.

For causing the tubes to move up automatically, the further development of the invention is especially suited, wherein the feed device comprises a tube magazine, which connects to the guide means.

To be able to perform the sequences of movements for positioning and putting on the tubes as quickly and as accurately as possible, the tube slip-on device comprises a vertical drive and a horizontal drive, which are controllable independently of each other for moving the guide means.

BRIEF DESCRIPTION OF THE DRAWINGS

In the following, further advantages of the invention are described in greater detail by means of several embodiments which are described with reference to the attached Figures, in which:

FIGS. 1.1 and 1.2 are schematic front views of a first embodiment of a winding machine according to the invention;

FIGS. 2.1–2.4 are schematic side views of the embodiment of FIGS. 1.1 and 1.2.

DETAILED DESCRIPTION OF THE PREFERRED EMBODIMENTS

Figure 3:
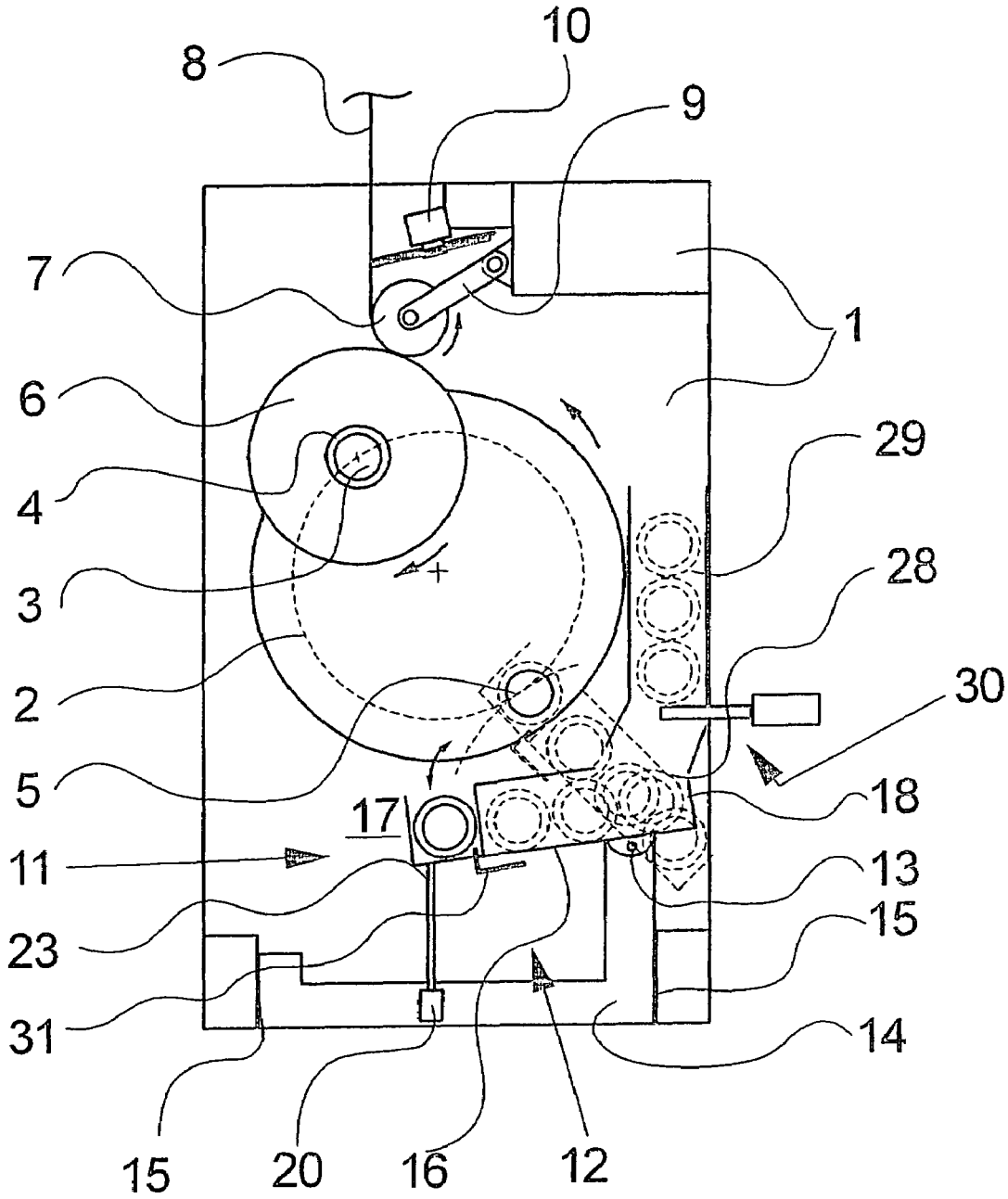
FIG. 3 is a schematic front view of a further embodiment of the winding machine according to the invention.

FIGS. 1.1 and 1.2, and 2.1–2.4 schematically illustrate a first embodiment of the winding machine according to the invention. In this connection, FIGS. 1.1 and 1.2 as well as FIGS. 2.1, 2.2, 2.3, and 2.4 show different operating situations of the winding machine. The following description will apply to all Figures, unless express reference is made to one of the Figures.

The winding machine comprises a movable spindle support 2, which is rotatably supported in a machine frame 1 so as to define a horizontal central axis. The spindle support 2 is constructed as a turntable or turret and driven anticlockwise by a rotational drive unit 19. The spindle support 2 mounts in cantilever fashion, 180° out of phase, two winding spindles 3 and 5. The winding spindles 3 and 5 are rotatably supported on the spindle support 2 so that their rotational axes are parallel to the central axis. At their supported end, the winding spindles 3 and 5 connect to their respective spindle drive 21 and 22. The opposite ends of the winding spindles 3 and 5 project freely.

Above the spindle support 2, the machine frame 1 mounts a contact roll 7 by means of a rocker arm 9. The contact roll 7 extends substantially over the entire length of the winding spindles 3 and 5. Above the contact roll 7, a yarn traversing device 10 is supported on the machine frame 1. In the present embodiment, the yarn traversing device 10 is symbolically shown as a rotary blade type traversing system, in which two oppositely driven rotors with a plurality of blades reciprocate in a winding position a yarn for depositing it on a package. However, the yarn traversing device 10 may also be formed by different systems, such as, for example, a traversing system using a cross-spiraled shaft.

As shown in FIGS. 2.1–2.4, the illustrated embodiment comprises three winding positions, in each of which a yarn 8 is wound to a package 6. Associated to each winding position are a traversing unit of the yarn traversing device 10 and a tube 4 on the winding spindle 3. The tubes 4 are supported in spaced relationship on the winding spindle 3.

For winding, a yarn 8 is supplied to each winding position via a yarn guide (not shown). In the winding position, the yarn 8 advances through the yarn traversing device 10, which reciprocates the yarn 8 within a traverse stroke. Subsequently, the yarn 8 is guided over the contact roll 7 with a partial looping and deposited on the surface of package 6. In the winding position, the package 6 is driven by the winding spindle 3 and spindle drive 21. In this process, the drive of the winding spindle 3 occurs such that the circumferential speed on the package 6 remains constant, while the yarn 8 is being wound. To enable a buildup of the package 6, the rotational drive unit 19 rotates the spindle support 2 slowly in the anticlockwise direction about its central axis.

On the winding spindle 3, three packages 6 are wound in parallel side-by-side relationship. As soon as the packages 6 are fully wound, the rotational drive unit 19 of the spindle support 2 is activated such that the winding spindles 3 and 5 are exchanged, and the yarn is transferred. With that, the winding spindle with the fully wound packages moves to a doffing position, and the winding spindle with the new tubes rotates into the winding position.

In the situations shown in FIGS. 1.1 and 1.2 and 2.1–2.4, the winding spindle 3 is in the winding position, and the winding spindle 5 in the doffing position. The fully wound packages have already been removed from the winding spindle 5. To this end, the winding machine comprises a removing device (not shown), which is used to slide the tubes with the fully wound packages axially off the winding spindle 5. After the fully wound packages have been pulled off and removed from the winding spindle 5, the latter will receive new tubes 4.

To supply the new tubes 4, a tube slip-on device 11 is arranged in the lower portion of the machine frame 1. The tube slip-on device 11 comprises a guide means 12 for positioning and sliding the tubes 4 onto the winding spindle 5. In the present embodiment, the guide means 12 is constructed as a trough-like tube carrier 16. With its one end, the support end 18, the tube carrier 16 is pivotally mounted on a pivot pin 13. At its opposite end, the so-called feed end 17, the tube carrier has an opening 23 which is made such that it permits inserting and removing a tube 4 both in the radial and the axial directions. A vertical drive 20 engages the tube carrier 16, which permits pivoting the tube carrier 16 from a standby position below the winding spindle 5 to an operating position at the height of the winding spindle 5. The vertical drive 20 may be, for example, a pneumatic cylinder.

The tube carrier 16 and the pivot pin 13 are arranged on a carriage 14. The carriage 14 moves in a carriage guideway 15 in the lower portion of the machine frame 1. For an axial displacement parallel to the winding spindle 5, the carriage 14 is provided with a horizontal drive 24. With this drive, it is possible to move the carriage 14 in the carriage guideway 15 between an outer and an inner position. FIG. 2.1 illustrates the carriage 14 in an inner position, and FIG. 2.2 in an outer position.

The tube carrier 16 has a width that extends substantially over the entire length of the winding spindle 5, as can be noted from FIG. 2.1. Inside the trough-like tube carrier 16, a plurality of compartments 25 extend, one after the other, which are separated from one another by spacers 26. At the feed end 17, each compartment 25 holds a tube 4 for supplying it to the winding spindle 5. Each compartment 25 is associated to one of the winding positions, with the spacers 26 corresponding in their size to the spacing of the tubes 4 positioned on the winding spindle 3. The tubes 4 are axially secured in the compartments 25, so that when being slid onto the winding spindle 5 by means of the tube carrier 16, the tubes 4 are simultaneously being positioned on the winding spindle 5.

As can be noted from FIG. 1, the tube carrier 16 has a depth, which permits it to receive a plurality of side by side tubes per winding position. In this connection, the tube carrier 16 is moved in the standby position to an inclined orientation, in which the support end 18 of the tube carrier 16 is positioned higher than the feed end 17. This ensures that after a tube slip-on procedure, tubes are automatically refilled at the feed end. Preferably, the tube carrier 16 has a partial cover, which has at the support end a second opening (not shown) for refilling tubes 4.

In the following, the sequence of slipping the tubes 4 on the winding spindle 5 is described in greater detail with reference to the operating situations shown in FIGS. 1.1 and 1.2 and 2.1–2.4. After the spindle support 2 has rotated the winding spindle 5 with fully wound packages to the doffing position, the tube carrier 16 is in its standby position, as shown in FIG. 1.1. In this position, the tube carrier 16 holds at its feed end 17 a plurality of co-axially extending tubes 4.

After having removed the fully wound packages from the winding spindle 5 by an auxiliary device on the winding machine, the horizontal drive 24 is activated, so that the carriage 14 moves from its inner position to an outer position. This movement can also be combined with a removing device on the winding device. FIG. 2.2 shows the situation of the moved out carriage 14.

Now, the vertical drive 20 as shown in FIG. 1.1 is activated for moving the tube carrier 16 from the standby position to an operating position. In the operating position, the feed end 17 of the tube carrier 16 directly faces the free end of the winding spindle 5. For positioning, the side of the tube carrier 16 that faces the winding spindle 5 mounts a slide shoe 27, which is brought into contact with the circumference of the winding spindle 5. Once the slide shoe 27 is in contact with the circumference of the winding spindle 5, a desired positioning of the tube carrier 16 is achieved, so that the opening 23 of the tube carrier 16 with the tubes 4 held at the feed end 17 is aligned with the winding spindle 5. This situation is shown in FIGS. 1.2 and 2.3.

The further sequence of placing the tubes 4 on the winding spindle 5 can be noted from FIG. 1.2. At the beginning of the tube slip-on process, the winding spindle 5 and the tube carrier 16 are held in the position A. The pivot pin 13 and the tube carrier 16 are designed such that a pivotal path 33 of the tube carrier 16 and a guide path 32, along which the spindle support 2 moves the winding spindle 5, overlap by a certain amount. This amount is selected such that it is somewhat smaller than the acceptable position deviation of the tube for slipping it onto the winding spindle. For example, were the tube inside diameter 73 mm and the spindle outside diameter 72 mm, an acceptable deviation in the diameter from the ideally geometric location of 0.5 mm would result. If greater, it would be no longer possible to slide on tubes. As an amount of the overlap one could select in this instance an overlap of 0.3 mm for being able to slide on the tube. Thus, the amount of the overlap results in two separate positions A and B, in which it would be still possible to put on the tube.

The positions A and B thus show the acceptable common pivotal path, through which the tube carrier 16 passes synchronously with the winding spindle 5. The time in which the tube carrier 16 and the winding spindle 5 are synchronously moved, is defined by the buildup of the packages 6 that are being wound in the winding range on the winding spindle 3. Taking into account the foregoing amount of the overlap when winding a yarn with a coarse denier, this resulted in a time of about 90 seconds, which corresponded to a angle of rotation of the spindle support of about 8°. The amount of the overlap may be both positive and negative.

For sliding on the tubes 4 during this phase, the carriage 14 axially displaces the tube carrier 16 with the pivot pin 13. In so doing, the slide shoe 27 slides along the circumference of the winding spindle 5, and the free end of the winding spindle 5 engages the opening 23 in the tube carrier 16, and extends through the tubes 4 held in the individual compartments 25. The horizontal drive 24 returns the carriage 14 to its inner position. In so doing, the tubes 4 reach their position provided on the winding spindle 5. Once the carriage 14 has reached its inner position, the tubes 4 are positioned on the circumference of the winding spindle 5. This situation is shown in FIG. 2.4. It is now possible to pivot the tube carrier 16 by the vertical drive 20 from its operating position back to its standby position. In so doing, the tubes 4 positioned on the circumference of the winding spindle 5 are released from the tube carrier 16 via its opening 23. As soon as the tube carrier 16 reaches its standby position, a tube 4 moves up in each compartment 25 to the feed end 17. The tube slip-on device 11 is thus ready for supplying the next winding spindle with tubes.

In the embodiment shown in FIGS. 1.1 and 1.2 and 2.1–2.4, the tubes are manually refilled in the tube carrier 16. Basically, however, the tubes could also be supplied from a tube magazine directly to the tube carrier 16. Such an embodiment is shown in FIG. 3. The embodiment of FIG. 3 is largely identical with the foregoing embodiments, so that the foregoing description can herewith be incorporated by reference, and only differences are described.

The guide means 12 is likewise constructed as a trough-like tube carrier 16. In this embodiment, however, the tube carrier 16 comprises at its support end 18 a refill opening 28. Above the refill opening 28 of the tube carrier 16, a tube magazine 29 is laterally provided on the machine frame 1.

The tube magazine 29 extends over the entire width of the tube carrier 16 and accommodates a supply of tubes 4 for each winding position. At the lower end of the tube magazine 29 a retaining device 30 is provided, which is movable between a holding position as shown in FIG. 3 and an opened position. In the opened position, the tubes 4 stored in the tube magazine are automatically removed from the tube magazine 29 and guided through the refill opening 28 into the trough-like tube carrier 16. In the trough-like tube carrier 16, the tubes automatically roll to the feed end 17. For securing the tubes 4 at the feed end 17, the tube carrier 16 comprises a blocking device 31, which prevents the tubes held at the feed end 17 from rolling back. The tube carrier 16 is pivotally mounted with its support end on the pivot pin 13, which is arranged on the carriage 14.

For the further construction and the further function of the tube slip-on device shown in FIG. 3, the foregoing description is herewith incorporated by reference.

The construction of the tube slip-on device shown in the illustrated embodiments is exemplary. For example, the guide means of the tube slip-on device could also be formed by a gripper or a mandrel. With that, the invention extends to similar constructions of the winding machine and the tube slip-on device, in which the tube slip-on device for supplying tubes to a winding spindle comprises a guide means, which moves synchronously together with a winding spindle driven by a spindle support for at least a short time for supplying the tubes. However, it is also possible to combine the tube slip-on device with a package removing device. With that, it would be possible to replace external doffer systems. Furthermore, the tubes could be floatingly stored in their receptacle, i.e., the receptacle is not rigidly connected to the guide means, but is able to move independently thereof to a slight extent. With that, it would be possible to adjust possible alignment errors.

From the above, it will be apparent that the phrases "winding position" and "doffing position" as used in the specification and claims, do not refer to a fixed location, but rather they are used to refer to the area or range in which these operations are performed.

The invention claimed is:

1. A winding apparatus for continuously winding an advancing yarn to a package, comprising a turret rotatably mounting a plurality of parallel winding spindles in cantilever fashion, a spindle mount mounting the turret for rotation about a central axis which is parallel to the axes defined by the spindles, a drive for rotating the turret about the central axis and so that the spindles may be selectively moved about said central axis between a winding position and a doffing position, and with the drive being configured to rotate the turret about the central axis to accommodate the build of a package at the winding position, and a tube slip-on device for delivering and axially assembling at least one winding tube onto a spindle in the doffing position, said slip-on device comprising guide means for positioning at least one tube so that its axis is aligned with the axis of the winding spindle at the doffing position, and with the guide means being linked to the winding spindle so as to be moved for a distance synchronously with the movement of the winding spindle at the doffing position caused by the rotation of the turret about the central axis during winding of a package on the spindle located at the winding position.

2. The winding apparatus of claim 1 wherein the guide means is arranged laterally adjacent the turret and is mounted for lateral movement between a standby position spaced from the winding spindle at the doffing position and an operating position adjacent the winding spindle at the doffing position.

3. The winding apparatus of claim 2 wherein the guide means includes a slide shoe which, in the operating position, is linked to the winding spindle by contact with the winding spindle in the doffing position.

4. The winding apparatus of claim 3 wherein the slide shoe is configured to contact the winding spindle in the doffing position to effect a mechanical linkage and so that the rotational movement of the turret laterally moves the guide means for said distance.

5. The winding apparatus of claim 4 wherein the slip-on device includes means for moving the guide means in a direction parallel to the central axis, so as to cause the at least one tube to be slipped onto the winding spindle at the doffing position.

6. The winding apparatus of claim 2 wherein the guide means comprises a tube carrier having a configuration for receiving at least one tube therein and with the tube carrier being pivotably supported at a support end on a pivot pin for pivotal movement about a pivotal axis which is parallel to said central axis and between said standby and operating positions, and with said tube carrier having at its end opposite said support end an opening for releasing the at least one tube received therein.

7. The winding apparatus of claim 6 wherein the pivot pin and the tube carrier are mounted on a carriage which is mounted f Dr movement in opposite directions parallel to the central axis.

8. The winding apparatus of claim 7 wherein the tube carrier has a width sufficient to accommodate a plurality of coaxially aligned tubes and so that a plurality of tubes can be concurrently assembled onto the winding spindle at the doffing position.

9. The winding apparatus of claim 8 wherein the apparatus defines a plurality of winding positions spaced along the length of the winding spindles so as to permit the concurrent winding of a plurality of packages on the spindle at the winding position, and wherein the tube carrier is divided over its width into a plurality of separate compartments, with each of the compartments accommodating a tube that is associated to one of the winding positions on the winding apparatus.

10. The winding apparatus of claim 9 wherein the compartments are arranged in spaced relationship with one another, with the spacing being adapted for positioning the tubes on the winding spindle so as to be respectively aligned with a winding position of the winding apparatus.

11. The winding apparatus of claim 9 wherein the tube carrier has a depth sufficient for receiving a plurality of tubes per winding position.

12. The winding apparatus of claim 6 wherein in said standby position, the tube carrier extends with its support end higher than said opposite end, so that the tube carrier is inclined for moving a tube therein toward said opening at its opposite end.

13. The winding apparatus of claim 12 wherein the tube carrier includes in the region of said opening a blocking device which permits a tube to be held at the opposite end of the carrier tube during pivotal movement of the tube carrier.

14. The winding apparatus of claim 6 wherein the tube slip-on device further comprises a tube magazine which is adapted to feed tubes into a refill opening adjacent the support end of the tube carrier.

15. The winding apparatus of claim 6 wherein the central axis is horizontal and wherein the tube slip-on device further comprises a drive for pivoting said tube carrier about said pivotal axis and a horizontal drive for moving the tube carrier in a direction parallel to said central axis, and with the two drives being indespendently operable.

16. A winding apparatus for continuously winding an advancing yarn to a package, comprising a turret rotatably mounting a plurality of parallel winding spindles in cantilever fashion, a spindle mount mounting the turret for rotation about a horizontal central axis which is parallel to the axes defined by the spindles and so that the spindles may be selectively moved about said central axis between a winding position and a doffing position, and a tube slip-on device for delivering and axially assembling at least one winding tube onto a spindle in the doffing position, said slip-on device comprising a carriage mounted for selective movement in a direction parallel to the central axis, a tube carrier for supporting at least one tube and being pivotally mounted to said carriage for pivotal movement about a horizontal pivot axis between a standby position and an operating position wherein the at least one tube is supported in axial alignment with a spindle at the doffing position, and with the tube carrier being moveable about said pivot axis for a distance synchronously with the movement of the winding spindle at the doffing position caused by the rotation of the turret about the central axis during winding of a package on the spindle located at the winding position.

17. The winding apparatus of claim 16 wherein the tube slip-on device further comprises a drive for selectively moving the carriage in opposite directions along a direction parallel to the central axis, and a drive for selectively pivoting the tube carrier about said pivot axis between said stand-by and operating positions.

18. The winding apparatus of claim 17 wherein the tube slip-on device further comprises a tube magazine which is configured to feed tubes into a refill opening in said tube carrier.

19. The winding apparatus of claim 17 wherein the tube slip-on device further comprises a guide shoe for mechanically linking the tube carrier in its operating position to the spindle at the doffing position to thereby cause the tube carrier to move with the spindle for said short distance.

* * * * *

UNITED STATES PATENT AND TRADEMARK OFFICE

CERTIFICATE OF CORRECTION

PATENT NO. : 7,097,129 B2
APPLICATION NO. : 10/899290
DATED : August 29, 2006
INVENTOR(S) : Matthies It is certified that error appears in the above-identified patent and that said Letters Patent is hereby corrected as shown below:

Column 8,
Line 30, “f Dr” should read --for--.

Column 9,
Line 6, “indespendently” should read --independently--.

Signed and Sealed this

Ninth Day of January, 2007

JON W. DUDAS
*Director of the United States Patent and Trademark Office*